US007281361B2

(12) United States Patent
Wooldridge

(10) Patent No.: US 7,281,361 B2
(45) Date of Patent: Oct. 16, 2007

(54) METHOD OF ARTICLE PORTIONING

(75) Inventor: Donald R. Wooldridge, Dunkirk, MD (US)

(73) Assignee: Diamond Machine Werks, Inc., Arlington Heights, IL (US)

( * ) Notice: Subject to any disclaimer, the term of this patent is extended or adjusted under 35 U.S.C. 154(b) by 0 days.

(21) Appl. No.: 11/622,916

(22) Filed: Jan. 12, 2007

(65) Prior Publication Data

US 2007/0118247 A1 May 24, 2007

Related U.S. Application Data

(62) Division of application No. 11/181,827, filed on Jul. 15, 2005, now Pat. No. 7,174,693.

(51) Int. Cl.
*B65B 1/04* (2006.01)

(52) U.S. Cl. ..... 53/473; 53/55; 53/495; 53/239; 53/244

(58) Field of Classification Search ..... 53/473, 53/475, 55, 58, 67, 495, 239, 500, 501, 502–504, 53/244, 247, 250; 198/367.1, 451; 221/12; 209/551, 559, 576, 586, 592, 645, 650, 652
See application file for complete search history.

(56) References Cited

U.S. PATENT DOCUMENTS 3,618,819 A * 11/1971 Blackburn et al. ..... 221/2
4,031,999 A * 6/1977 Wagner et al. ..... 198/418
4,117,935 A * 10/1978 Richardson et al. ..... 378/89
4,353,195 A * 10/1982 Nakamura ..... 53/54
4,367,653 A * 1/1983 Richter et al. ..... 73/861.21
5,313,508 A 5/1994 Ditman et al.
5,454,016 A 9/1995 Holmes
5,787,678 A * 8/1998 Koike et al. ..... 53/154
5,804,772 A 9/1998 Wooldridge et al.
6,360,870 B1 3/2002 Wooldridge
6,563,901 B2 5/2003 Woodridge
6,792,736 B1 * 9/2004 Takahashi et al. ..... 53/237
6,799,684 B2 10/2004 Wooldridge
6,836,527 B1 12/2004 Wooldridge et al.
6,899,144 B1 * 5/2005 Geltser et al. ..... 141/2
6,899,148 B1 * 5/2005 Geltser et al. ..... 141/104

* cited by examiner

*Primary Examiner*—Hemant M. Desai
(74) *Attorney, Agent, or Firm*—James P. Hanrath

(57) ABSTRACT

A method for detecting and discriminating articles that are within a predetermined range of a specification into lots feeds a plurality of articles into an article portioning system having a counting head assembly that includes an article detecting unit located above and cooperatively controlling through generated signals an upper diverting gate and lower outlet gate which control the passage and/or accumulation of articles in adjacent channels to permit filling of article containers with predetermined article portions as containers are placed beneath, and removed from, the assembly outlet. The method for portioning discrete articles by feeding the articles and generating signals controlling the gates is suited for a combined plurality of such assemblies to provide high speed continuous container filling operations for simultaneous filling of groups of containers.

3 Claims, 7 Drawing Sheets

Fig. 5A
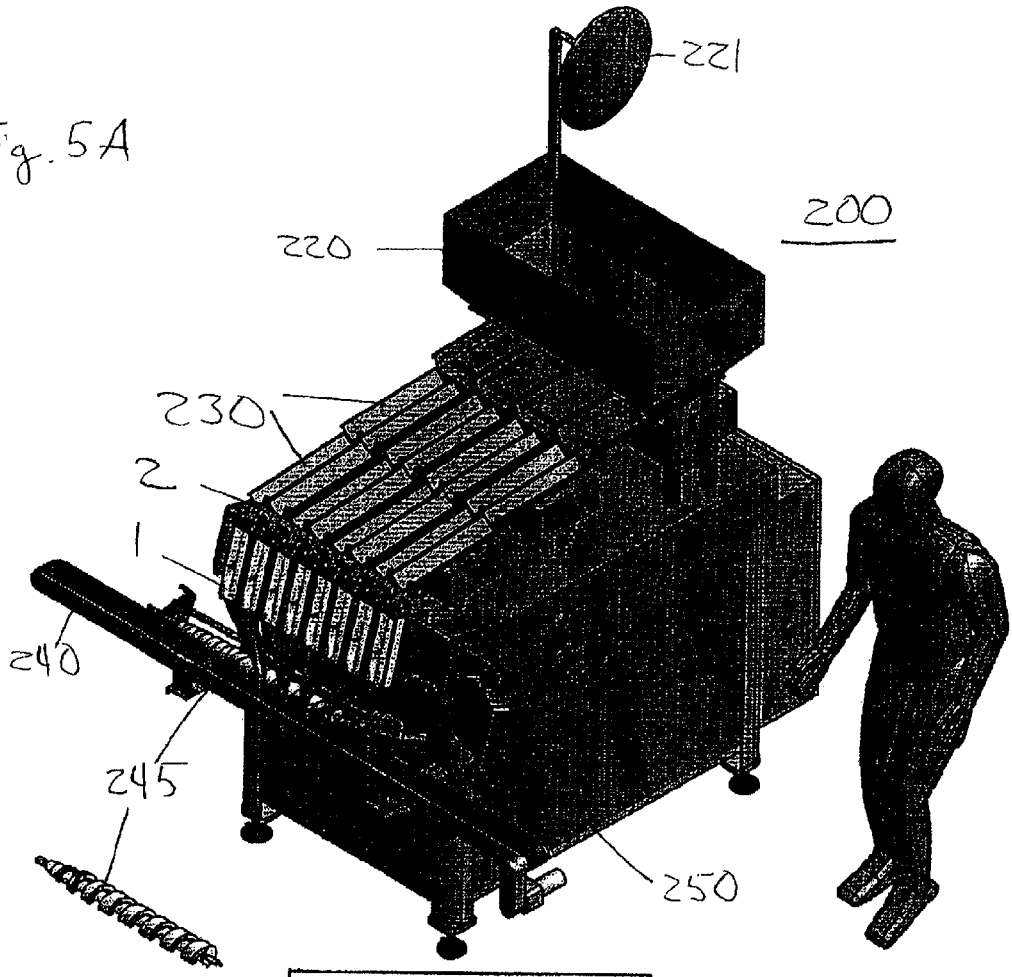
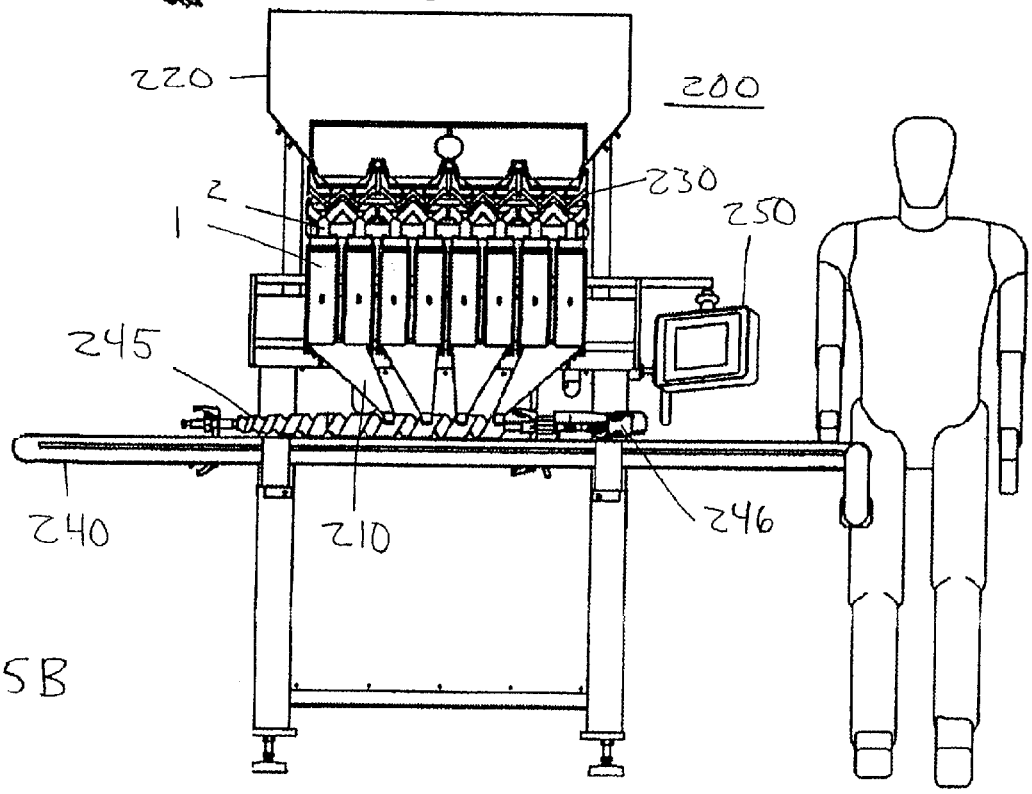
Fig. 5B

METHOD OF ARTICLE PORTIONING

CROSS REFERENCE TO RELATED APPLICATIONS

The present application is a divisional application of U.S. Pat. Ser. No. 11/181,827, filed on Jul. 15, 2005 now U.S. Pat. No. 7,174,693 issued on Feb. 13, 2007.

BACKGROUND AND SUMMARY OF THE INVENTION

This invention relates to an apparatus and method for detecting and discriminating articles that are within a predetermined range of a specification into lots. More particularly, this invention relates to an apparatus and method for detecting and discriminating articles that have been separated and singulated while being conveyed to the apparatus of the present invention, and a system and method for simultaneous high speed processing of articles. The specification could be volume, individual or total, of articles; size or other physical characteristic of the articles; count of articles; or combinations of these properties.

Devices for counting or aggregating articles are known. For example, U.S. Pat. Nos. 5,313,508 and 5,454,016, which are incorporated herein by reference in their entireties, disclose methods and apparatus for counting irregularly shaped articles. A pair of alternately energized light sources is provided at a sensing plane through which articles to be counted pass. Each of the light sources emits a light beam that is at an angle to the other light beam, such as an angle of about 90°.

U.S. Pat. No. 6,836,527 B1, also incorporated herein by reference in its entirety, further improves on the foregoing methods and apparatus for counting articles by providing reliable counting of unsymmetrical articles by volume or partial volume, using three-dimensional imaging of the articles as they traverse the light beams and sensors of the apparatus. This latter apparatus and method also allows for sensing of the most efficient throughput counting speed for the particular articles being counted, enabling feedback adjustment of article feed rates into the apparatus.

U.S. Pat. No. 5,804,722, which is incorporated herein by reference in its entirety discloses an apparatus and method for aggregating a desired number of articles without individually counting out each article to achieve the desired number. A stream of the articles is discharged into a weigh hopper until substantially a predetermined weight of articles is in the hopper. The number of articles in the hopper is determined from the total weight of the hopper and the weight of a single article.

U.S. Pat. No. 6,360,870, which is incorporated herein by reference in its entirety, discloses an apparatus which comprises a plurality of outlets radiating outwardly from the periphery of a feeder bowl. The number of outlets can be as few as two with no upper limit except as dictated by physical constraints. It is possible that as many as about 100 could be used depending on bowl size and/or diameter, and track size. Specifically, the device has multiple tracks spiraling or radially exiting out from a center cone or other structure. The tracks all have tooling designed to shed bulk loose product down to single file feed, exiting product in controlled flow from the bowl around the entire periphery at the end of each track. The bowl passes the excess overflow via an integral catch pan that provides a path for the bulk excess product to exit the bowl feeder from underneath the multiple tracks for a return run through the multi-track feeder. At each exit, an optical parts detector, laser, light beam, load cell, or similar type device, with a product diverter gate, and an accumulator with discharge gates, is positioned to count, weigh, apportion by volume, discriminate by some other characteristic of the articles, or some combination of these properties, the loose product into the desired batch size or volume. These detectors may combine their counts for large batch sizes, or each be individually programmed to count each total batch or any combination of these optical batches and weighed batches satisfying their requested batch size or volume.

In another aspect of the invention of the aforementioned U.S. Pat. No. 6,360,870, a bowl configuration is provided for bulk product distribution that can deliver product uniformly and/or oriented in a controlled fashion out its entire periphery overflowing out of itself evenly and smoothly around a 360 degree circle. This bowl is designed to receive bulk product from bucket conveyors, bin vibratory elevators, and/or other similar delivery means. This device by nature of its design shape will collect the product in the bottom center of a cone, bowl or other similar shaped device. The bowl has spiral vanes, tracks, diverters, or other similar devices affixed to its interior surfaces that will guide and encourage the product to climb out of and spread itself evenly and uniformly out of the periphery of the device.

U.S. Pat. No. 6,563,901 B2, which is incorporated herein by reference in its entirety, discloses a multi-head counting system in which a counter unit counts discrete articles within a predetermined size range into lots having a predetermined number of articles. The counter unit includes (1) a first conveyor that delivers a flow of articles separated at intervals, and (2) at least one bin positioned to receive articles from the conveyor. The at least one bin may have first and second outlet gates for emptying the articles into first and second separate locations. A detector unit counts the articles that are received from the conveyor into the at least one bin and which fall within the predetermined size range. A control unit causes the first outlet gate to open when the count of articles is equal to the predetermined number of articles. However, when an article falls outside the predetermined size range, the detector generates an out-of-size signal. The control unit, upon receipt of the out-of-size signal from the detector unit, causes the second outlet gate to open, thereby rejecting the articles. The counter unit may also be used for counting articles having a predetermined color into lots having a predetermined number of articles. When an article does not have the predetermined color, the detector generates an out-of-color signal. The control unit, upon receipt of the out-of-color signal from the detector unit, causes the second outlet gate to open, thereby rejecting the articles.

The counter unit of the aforementioned U.S. Pat. No. 6,563,901 B2 is quick and efficient. However, in certain applications, as non-limiting examples, in packaging of pharmaceutical dosage forms such as pills, capsules, or the like; or of foods such as candies (wrapped or unwrapped) or other mixtures of various ingredients, apportioning the articles by gross volume is more efficient. U.S. Pat. No. 6,799,684 B2, which is incorporated herein by reference in its entirety, discloses an article detecting and counting apparatus which comprises a detector unit which detects and maintains a count of articles that are received in the apparatus or which fall within a predetermined range of a predetermined specification such as volume, a diverter gate which holds and releases batches of articles for further processing, at least two outlet gates for emptying articles from apparatus into respective first and second locations in response to signals from a control unit which determines based on signals from the detector whether or not the count or volume of articles is equal to the predetermined number and/or volume of articles.

Notwithstanding the foregoing improvements in article detection, counting and packaging, the prior art systems are limited in their ability to provide high speed, verified accurate and repeatable batch processing and disposition of acceptable and rejected article batches.

It is, therefore, an object of the present invention to overcome the deficiencies of prior art devices and methods and to provide an apparatus and method for portioning articles that accurately counts a predetermined number of discrete articles, regardless of size and/or shape, and/or dispenses articles that are within predetermined specifications such as total size or volume or color (or combinations of such specifications), at a higher article throughput while maintaining very high levels of accuracy. For convenience in the following description of the present invention, and in particular preferred embodiments thereof, the terms "portioning head" and "counting head" are to be understood as referring to the same concept, i.e., a device which detects and accumulates information regarding articles passing therethrough and determines the number and/or other characteristics of the articles passing through the detector.

It is another object of the present invention to provide an article detecting and portioning apparatus that is relatively simple and inexpensive to manufacture and to maintain, and that is relatively easy to maintain with high levels of cleanliness.

It is a further object of the present invention to provide for continuous accumulation of articles during indexing of the portioning head and/or a container to be filled into and/or out of a fill zone.

It is another object of the present invention to provide a counting apparatus and system which employs fewer article flow control devices such as diverting gates, and substantially reduces and/or eliminates the need for article flow control device position sensors to determine device position and/or jam or fault conditions.

It is another object of the present invention to provide an apparatus and method in which a plurality of counting heads of the aforementioned type are co-located and arranged to provide a high-speed, verified batch filling system for continuous or near-continuous container filling operation.

Consistent with the foregoing objects, the present invention provides an article detecting and counting head apparatus, a multi-head article processing apparatus comprising a plurality of said article detecting and counting head apparatus, and associated methods for operating same. The articles could be essentially any loose articles, such as pieces of candy (wrapped or unwrapped), pharmaceutical products such as tablets, capsules, or any other dosage form which can be subjected to handling, non-consumable products such as pellets used to inflate vehicle airbags or electronic components such as chips, resistors, capacitors, transistors, or the like; or any other type of product to be separated from bulk quantities into individual or multiple package units, as long as they can be handled in bulk and separated into discrete units to, for example, have their volume determined, to be counted, measured and/or weighed, or to be otherwise subjected to measurement of other physical characteristics such as color, shape, or the like, or combinations thereof, such as volume determinations combined with count or color determination.

The counting head apparatus includes a detector unit which detects and maintains a count of articles that are received in the apparatus or which fall within a predetermined range of a predetermined specification such as volume, which detector generates an out-of-specification signal when an article or group of articles received in the apparatus falls outside the predetermined range. The detector is located in or near a chamber positioned to receive articles from a flow of articles delivered to the apparatus. An upper diverting gate is disposed in the chamber, and is arranged to alternately direct articles fed into the chamber into either of two channels within the chamber. The diverting gate position is controlled by a smart gate repositioning device, such as a smart servo motor unit, a smart stepper motor unit or the like, which can provide signals indicating the position of its drive mechanism. For convenience, hereinafter, the term "smart servo motor" is to be understood as referring generally to any gate reposition device, including smart stepper motors and the like.

A lower outlet gate, also controlled by a smart servo motor, alternates between the two channels within the chamber, independent from the diverter gate position, to control the accumulation and release of articles in the counting head. A control unit receives signals from at least the detector unit and the upper diverting gate and lower outlet gate smart servo motors to determine and command the positioning of the diverting and outlet gates and to control the feed rate of articles into the counting head chamber from an article feed device (not illustrated) to optimize counting accuracy and article batch processing speed.

In operation, the counting head apparatus receives articles into the chamber, which are detected as they pass through the detector unit. At the beginning of the accumulation of a batch of articles, the diverting gate is positioned by the smart servo motor to one side or the other of the chamber in order to divert the incoming articles into one of the two channels. For illustrative purposes, in this example the diverting gate is set toward a left side of the chamber, such that the articles are diverted into the right of the two channels. At the same time the outlet gate is positioned to block the outlet of the other channel (the left channel in this example), such that the articles entering the right channel may pass through the chamber to be received in a container, such as a plastic bottle for pharmaceutical tablets or other type of container or packaging. When the detector unit detects the count or volume of articles that have passed through the chamber is equal to the predetermined number and/or the articles fall within the predetermined range of the predetermined volume, the control unit commands the diverting gate to move to block the opposite channel (in this example, from blocking the left channel to blocking the right channel), thereby diverting the flow of articles into the left channel, where they begin to accumulate above the outlet gate. While articles continue to be counted by the detector unit and accumulate in the left channel, a new empty container is positioned below the counting head by indexing the counting head to a position over a new container and/or indexing a new container below the counting head. Once indexing is complete, the control unit commands the outlet gate to move to block the outlet of the other channel (in this example, from blocking the left channel outlet to blocking the right channel outlet), allowing the accumulated articles to drop into the new empty container. If the number or volume of articles accumulated at the time the outlet gate is repositioned is a partial batch, additional articles are allowed to pass through the channel into the container until the detector unit determines a complete batch has passed through the detector and the control unit commands the diverting gate to block the open channel (in this example, the left channel). The alternating partial accumulation process then begins anew with the accumulation of articles in the other channel (in this example, the right channel) while indexing to locate a new container beneath the counting head is completed. The present invention's counting head therefore provides the ability to accumulate and dispense predetermined batches of articles on an continuous, uninterrupted flow basis.

In the event the detector unit determines that the article characteristic being detected (e.g., count, volume, color) is outside the predetermined acceptable range, the accumulated batch is identified as bad. There are various possible approaches available for removing the bad batch from the product packaging stream, such as electronic identification of a container filled with the bad batch for removal from the container filling line downstream from the counting head, or controlling the outlet gate to release the accumulated bad batch at a time when a container is not indexed below the counting head, such that the bad batch passes to a rejected batch accumulation bin, preferably for inspection and/or recycling back into the article feed system.

In a further embodiment of the present invention, a plurality of the aforementioned counting heads are co-located to receive articles from a common supply device, and a continuous supply of containers to be filled are fed into fill positions beneath the counting heads to receive article batches accumulated in the counting heads. In one embodiment of this batch counting system, the plurality of counting heads are mounted on an outer periphery of a carousel-type rotary article feed platform. As the rotary feed platform rotates, a container feed conveyer directs empty containers onto the carousel beneath the counting heads, such that a container is located beneath each counting head for the majority of a revolution of the carousel. As the containers near the completion of a revolution of the carousel, the now-filled containers may be directed off the carousel back onto another conveyer for transport downstream for further processing. The containers are filled in the following manner. As the carousel rotates, a source of articles, such as a vibratory conveyer, feeds articles to the top of the feed platform. The feed platform, which may be shaped as a flat cone, distributes the articles uniformly radially outwards towards the entrances of the plurality of counting heads. The feed rate of the articles and the carousel rotation rate are controlled such that by the time the counting head and its associated container have reached the point of removal of the container from the carousel, a complete batch has been received in the container. Due to the present invention's advantages in supporting continuous counting and accumulation, during the period of carousel rotation when a counting head is not indexed over a container (i.e., between the time a filled container is removed from the carousel and the counting head is rotated around the carousel to meet a new container entering the carousel), articles may continue to be fed into the counting head from the continuous article feed platform. Once indexed above a container, the controller may reposition the counting unit's outlet gate to allow the accumulated articles to fall into the container and permit further articles to fall through the open channel into the container until a complete batch is received and the diverting gate is repositioned to stop filling and begin accumulation in the other channel while the filled container is removed from the carousel. The control unit may also be provided with feedback control in order to control the feed rate of the articles onto the feed platform and/or the carousel rotation speed, such that the counting heads are receiving articles at a rate which optimizes the detector unit accuracy, while also receiving a sufficient amount of articles to complete a batch by the time each counting head reaches a predetermined position around the carousel. Controlling feed rate and carousel rotation speed in this manner ensures the container will receive the complete batch before the container leaves the carousel.

Other multi-head continuous batch filling configurations are also possible. For example, rather than the foregoing rotary carousel counting head and container indexing system, a linear filling station may be constructed, in which a plurality of counting heads are arranged, for example, adjacent to one another. In such a system, a continuous article feed system, such as a bin-fed vibratory feeder, uniformly feeds articles to the tops of each of the counting head chambers. Due to the continuous counting and accumulation capability of the present invention, while the counting heads are accumulating articles, groups of empty containers are advanced along a container conveyer beneath the counting heads, with one container indexed beneath each counting head. When the containers are indexed into their respective fill positions, the control unit may reposition the outlet gate to permit the accumulated articles to fall into the containers and to allow the remaining articles in the batch to pass through the open channel until the batch is complete. Once the detector unit determines the batch is complete and the control unit repositions the diverting gate to block the channel feeding the container, and all the counting head diverting gates are repositioned, the group of filled containers is conveyed downstream and a new group of empty containers is indexed into position beneath the counting heads. The control unit then may reposition the outlet gates to restart the container filling process.

Advantageously, because the counting heads of the present invention employ smart gate repositioning devices, the control unit can readily detect article jamming and other flow control problems by determining that the gates are not in the commanded position. For example, in the event a gate is not completely closed due to accumulated articles jammed between the chamber wall and the gate, the servo or stepper motor position indication would indicate that the gate is not fully closed. The controller therefore can detect errors and react (such as initiating alarms or shutting down filling system operation), without the need for additional, dedicated sensors. In addition, because the smart servo motors allow very fine gate motion control, the gates may be repositioned at very high speed, but decelerated as they near the chamber wall in order to reduce or eliminate the high-speed gate impact with the chamber wall. This feature allows higher continuous counting and filling system operating speeds without exceeding gate and chamber component wear and high operating noise levels from gate/wall impacts. The position indication and associated fine control of the stepper or servo motors also allows for controlled release of articles which have accumulated above an outlet gate, minimizing the potential for clogging of the chamber outlet by sudden release of a large number of accumulated articles. The fine control over gate position permits the outlet gate to be controlled to initially open slowly, so that only a fraction of the accumulated articles begins to fall towards the chamber outlet, to be followed by the rest of the accumulated articles as the gate begins to accelerate towards its new position.

Other objects, advantages and novel features of the present invention will become apparent from the following detailed description of the invention when considered in conjunction with the accompanying drawings.

BRIEF DESCRIPTION OF THE DRAWINGS

FIG. 5A is a perspective view of a linear counting and filling apparatus in accordance with a further embodiment of the present invention; and FIG. 5B is an elevation view of the embodiment of the present invention shown in FIG. 5A.

DETAILED DESCRIPTION OF THE PREFERRED EMBODIMENTS

Figure 1A:
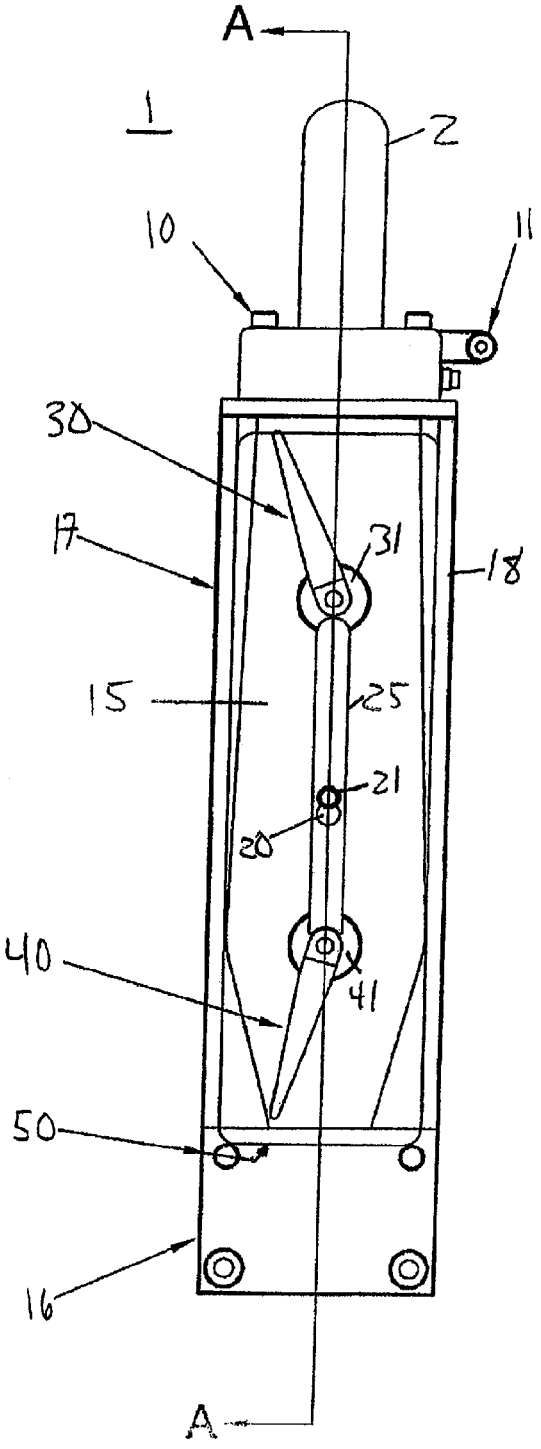
FIG. 1A is a front view of a counting head assembly in accordance with an embodiment of the present invention.
Figure 1B:
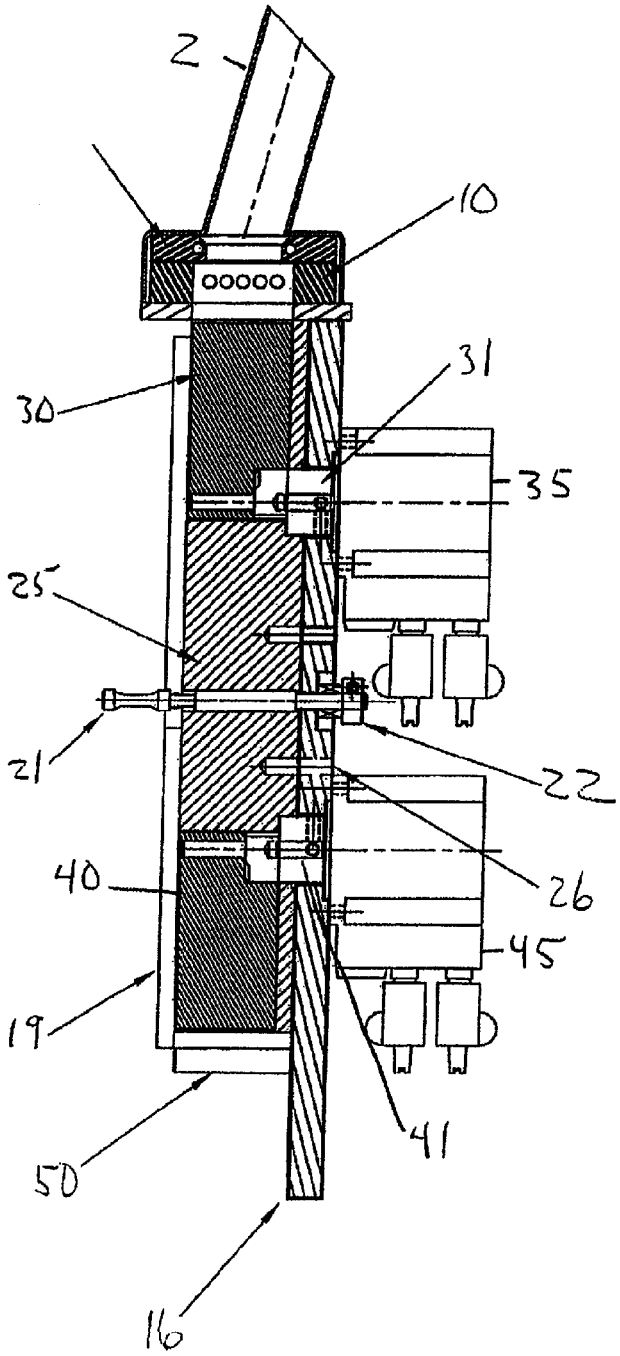
FIG. 1B is a cross-section view through plane A-A of the embodiment of the counting head assembly shown in FIG. 1A.

Referring first to FIGS. 1A and 1B, there is shown a counting head assembly generally designated by the numeral 1. At a top of the assembly, articles received from a feeder enter feed tube 2 and fall through an article detecting unit 10, preferably a light-sensing detector of the type according to the aforementioned U.S. Pat. No. 6,836,527 B1. Preferably, the detecting unit is capable of discriminating characteristics such as the volume or color of the articles passing through the detecting unit. However, such discrimination is not required if, for example, articles are to be packaged solely by count.

As the articles pass through detecting unit, they enter a chamber 15 formed from a back plane 16, side walls 17, 18 and front wall 19. Advantageously, front wall 19 is formed from a transparent plastic sheet, allowing monitoring of counting head performance, and the sheet is provided with a locating hole 20 corresponding to a retaining pin 21. This arrangement allows for easy, rapid disassembly of the counting head assembly for inspection, cleaning and maintenance without tools, as the front wall 19 may be easily removed from the front of counting head assembly 1 by sliding upwards a short distance and lifting over the retaining pin 21. The pressure applied by pin 21 to seal the edges of front wall 19 against the sides of the chamber is preferably adjustable, for example, by use of a threaded pin or pin cap, or, as illustrated in FIG. 1B, with a bushing and lock ring apparatus 22 at the rear of the chamber which draws the pin towards the rear of the chamber. The chamber is divided into left and right channels by a center divider 25, which in this embodiment is located by locating dowels 26 at a rear divider edge, and retained in the chamber at a front divider edge by front wall 19.

Adjacent to the top of center divider 25 is provided an upper diverting gate 30, which is rotatably mounted on a shaft 31 of a smart servo unit 35 to divert articles falling through detecting unit 10 into one of the left or right channels. Smart servo 35 in this embodiment is a model SM2315D servo unit available from Anamatics, Inc. of Santa Clara, Calif., however, alternative smart gate repositioning devices, such as the model M-Drive smart stepper motor unit available from IMS, Inc. of Marlboro, Conn. or the like, may be used. Smart servo 35 has the ability to position upper diverting gate 30 to any position between side walls 17 and 18. The smart servo 35 includes a high torque electric motor drive, and a processor which allows the unit to determine the rotary position of its shaft 31. In operation, once smart servo 35 has performed a start-up calibration to determine the position of its rotary shaft 31, the smart servo can move upper diverting gate 30 from a starting position to a desired end position at a very high, variable speed rotation, while controlling deceleration into the desired end position to prevent over-travel of gate 30. In addition, the smart servo 35 permits the exact tracking of the position and progress of the gate through its movement arc. This controlled, high speed motion avoids excess noise and gate and side wall wear from the gate striking the side walls, avoids damage to articles by minimizing the potential for the gate to trap the article against the side wall, and ensures that the gate can be moved in a manner which allows the free end of the gate to pass between the trailing edge of last article of an article batch and the leading edge of the first article of the next batch, which is to be diverted as it is falling into the other channel.

Preferably, the smart servo and/or its controller is programmed to position the upper diverting gate 30 sufficiently close to either side wall to prevent articles from passing between the gate and the side wall, or becoming lodged therebetween, but far enough away to permit high speed movement without wall strikes.

As a general rule, the higher the speed at which the gate is driven, the higher the rate at which articles may be fed into the counting head assembly, consistent with efficient and accurate detection by detecting unit 10. Once the detecting unit 10 has detected a complete batch of articles has passed by its sensors, the upper diverting gate must be repositioned (from a position diverting articles into one channel into a position which diverts further articles into the other channel) before the next article falling through the detecting unit reaches the diverting gate, in order to ensure that the completed batch does not receive additional articles. Thus, the feed rate of articles into the counting head assembly must be maintained such that the rate at which articles pass into the assembly (i.e., the distance between falling articles) is low enough such that the upper diverting gate 30 is in position to divert further articles before the first article of the next batch reaches the gate. Accordingly, the greater the gate rotation speed that can be generated by the smart servo 35, the higher the possible feed rate of articles into the counting head assembly without encountering article strikes by the gate which could introduce batch errors, and therefore the higher the article packaging production rate that can be achieved.

At the other end of center divider 25, a lower outlet gate 40, rotatably mounted on a shaft 41 of a second smart servo unit 45, is provided. As with upper diverting gate smart servo 35, servo unit 45 has the ability to position outlet gate 40 to any position between side walls 17 and 18. This gate is positioned to alternatively hold up (accumulate) articles in a channel, or to allow articles passing through a channel to pass out the counting head assembly outlet port 50. The articles passing through outlet port 50 may, for example, be received in article packaging containers (not illustrated).

Lower outlet gate 40 is capable of being repositioned by smart servo unit 45 independently of upper diverting gate 30.

The center divider 25, upper diverting gate 30 and lower outlet gate 40 are formed preferably from a rigid piece of plastic material, both to minimize the inertia of the gates, thereby maximizing their rotating speed for a given servo motor torque, and to facilitate easy cleaning. Further, gates 30 and 40 are each provided with a stepped, keyed, slip-fit mounting hole which corresponds to their respective smart servo unit shafts 31 and 41. So configured, the counting head assembly chamber may be very quickly and easily cleaned and/or serviced by disengaging and lifting front wall 19 off retaining pin 21, and then simply lifting center divider 25, upper diverting gate 30 and lower outlet gate 40 directly out of the chamber.

The chamber walls 17, 18, in this embodiment feature inner wall surfaces which taper away from the center of the chamber, at least in the upper and middle parts of the chamber. While such tapering is not a requirement of the present invention, tapering away from the center is helpful in minimizing the potential for article clogging due to bridging. In the lower portion of the chamber, beginning approximately adjacent to the pivot axis of the lower outlet gate, the chamber side walls 17, 18 taper inwardly to assist in directing articles toward the center of outlet port 50. Preferably, the degree of taper in the power portion of the chamber is low enough that the distance between the side wall and the outlet gate 40 increases in the direction of the outlet in order to further avoid clogging.

The operation of the counting head assembly in this embodiment is controlled by a control unit (not illustrated in FIGS. 1A, 1B). The control unit receives input signals from at least the detector unit from electronics connection 11 (e.g., batch complete or bad batch identified), and optionally, the smart servo motors 35, 45 (e.g., gate position), and generates output signals to command the positioning of the diverting gate 30 and the outlet gate 40, and to control the feed rate of articles into the counting head chamber. A demonstrative example of the coordinated operation of the counting head assembly components under the control of the control unit follows.

Figures 2A, 2B, 2C:
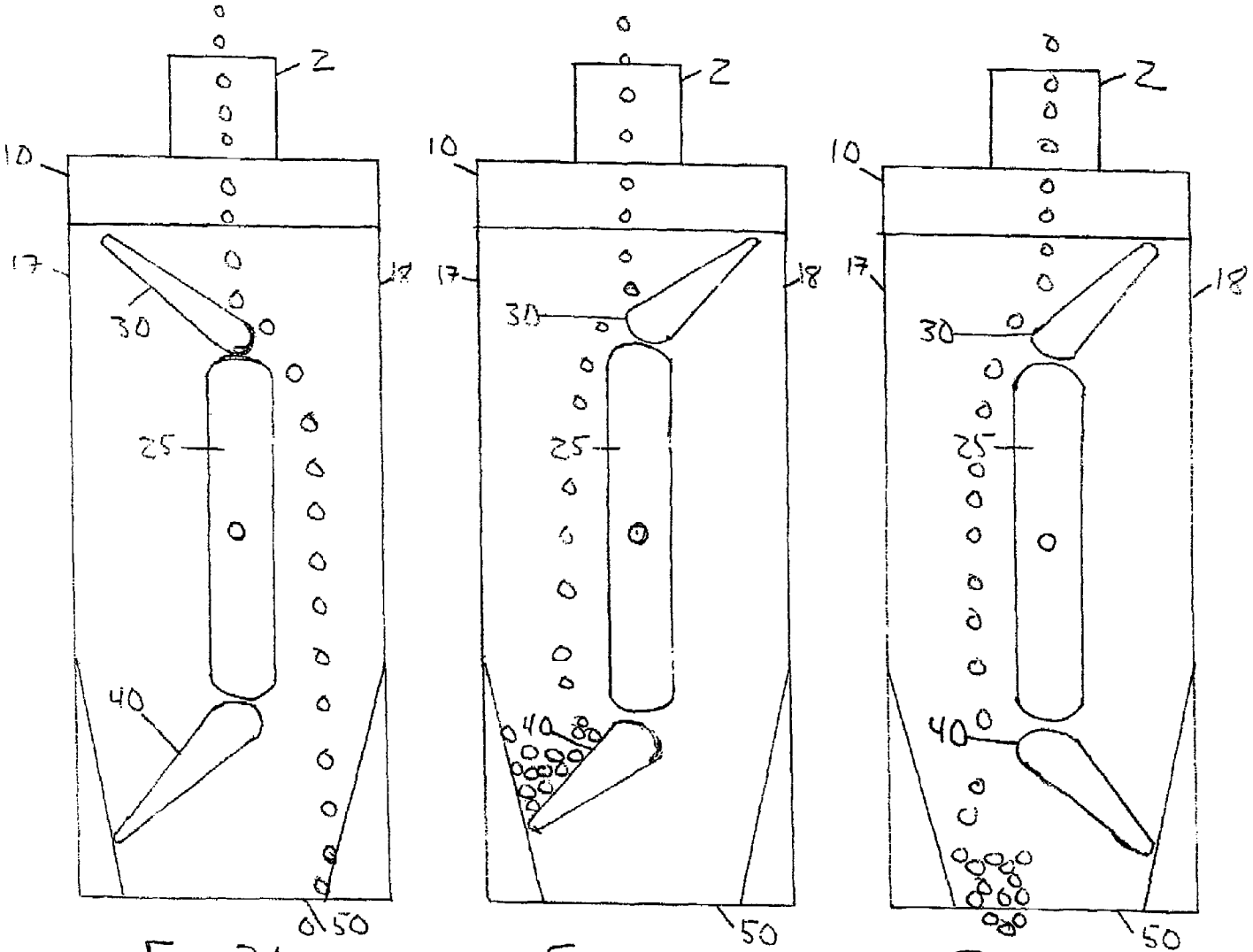
FIGS. 2A-2E are front views, schematically shown for illustrative clarity, of gate positioning during execution of an embodiment of the method of the present invention.

Referring now to FIGS. 2A-2E, and in particular to FIG. 2A, there is schematically illustrated the counting head assembly of FIGS. 1A and 1B. In FIG. 2A, articles fed into feed tube 2 pass through detecting unit 10 and are detected in the manner described in U.S. Pat. No. 6,836,527 B1. The articles pass into the chamber until they reach upper diverting gate 30, which in this embodiment is initially positioned to block the left channel. The articles accordingly fall through the right channel, and because the lower outlet gate 40 is initially positioned beneath the left channel, they continue to fall through outlet port 50 into a container below the counting head assembly (container not illustrated). When the detecting unit 10 detects that the count or volume of articles that have passed through the chamber is equal to the predetermined number and/or the articles fall within the predetermined range of the predetermined volume, the detector unit signals the control unit that the batch is complete. The control unit commands the diverting gate smart servo 35 to reposition diverting gate 30 to block the right channel. The feed rate of articles into feed tube 2 is controlled such that the distance between the falling articles is sufficiently large to permit the diverting gate 30 to block the channel before any additional articles can fall into the channel through which the complete batch has just passed (in the present example, the right channel). By controlling the repositioning of diverting gate 30 in this manner, the completed batch is not enlarged, and the flow of incoming additional articles can be safely and reliably diverted into the adjacent channel without product damage.

As illustrated in FIG. 2B, once the diverting gate 30 has been repositioned to block the right channel, the articles in the completed batch continue to fall into a container (not illustrated) below outlet port 50, while outlet gate 40 blocks the fall of additional articles into the outlet port. As the now filled container beneath outlet port 50 is removed and a new container is aligned with the outlet port, outlet gate 40 is maintained in the left channel-blocking position and additional articles accumulate in the left channel while the detecting unit continues to sense and count the entering articles.

FIG. 2C illustrates the gate positions and article flow once the new container is in position, either as a result of placement of the container beneath the counting head assembly or the indexing of the assembly over the new container. Once in place, the control unit commands the smart servo 45 to move the outlet gate 40 to a position under the right channel, thereby allowing the accumulated partial batch of articles to pass through outlet port 50 into the new container, and to allow further articles passing through the left channel to fall uninhibited into the container until a complete batch is counted.

Figures 2D, 2E:
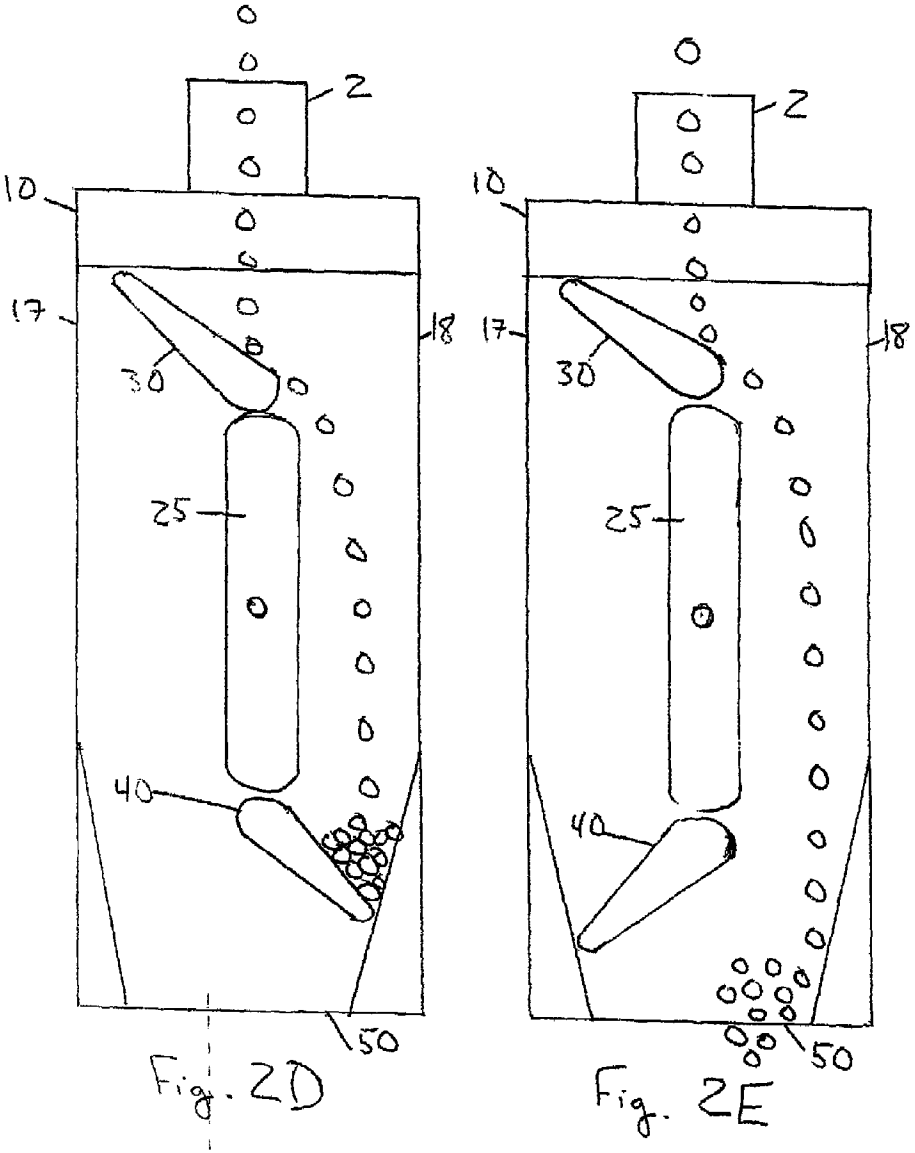

As illustrated in FIG. 2D, upon receiving the signal from the detecting unit 10 corresponding to completion of the batch passing through the left channel, the control unit commands the smart servo 35 to reposition the diverting gate 30 to block the left channel before the next article can enter the left channel, and the remaining articles in the left channel continue to pass into the container below. Because outlet gate 40 is now blocking out flow from the right channel, the articles diverted by diverting gate 30 into the right channel now begin to accumulate above the outlet gate 40 while the now filled container is replaced by a new container, as occurred with the left channel in FIG. 2B.

Finally, as illustrated in FIG. 2E, once the new container is in place below the outlet port 50, the control unit commands the smart servo 45 to reposition the outlet gate 40 to beneath the left channel, and the accumulated partial batch is allowed to fall into the new container and the remaining articles in the batch are allowed to pass through the right channel into the container without restriction, as was the case in the left channel in FIG. 2C. Upon repositioning of the outlet gate 40 beneath the left channel, the counting head assembly gates are in the initial operating positions illustrated in FIG. 2A, and the foregoing switching of the gates 30, 40 may continue as previously described, allowing continuous accumulation of article batches and filling of containers.

In the event the detecting unit 10 signals the control unit that the currently accumulating batch is a "bad" batch, for example, a batch which has a count or volume or color outside a predetermined range, the control unit may identify the bad batch for removal from the container filling and/or packaging process, for example, by allowing the filling of the container to proceed without interrupting the container filling process and electronically identifying the container with the bad batch for subsequent manual or automatic removal from the production line. Alternatively, the control unit may withhold the outlet gate 40 repositioning command until the counting head assembly is indexed above an article disposal position in which there is no container beneath the assembly, and then command repositioning of the outlet gate to allow the bad batch to be diverted into, for example, an article inspection/recovery bin. The articles thus accumulated may then be efficiently recycled into the article feed device for re-feeding into a counting head assembly.

The control unit in the present embodiment is also programmed to provide article feed rate control. As the articles pass through the detecting unit 10, signals received by the control unit from the detecting unit permit the control unit to determine whether the distance between the articles is great enough to ensure the diverting gate 30 can be repositioned before any additional articles fall into an already complete batch. The required distance between the articles can be readily calculated or empirically determined, based on the time required for the diverting gate to traverse between the channel positions, which in turn is dependent on the gate angular velocity generated by smart servo 35. If the article separation distance is insufficient, the control unit may command the feed device to slow article feeding into feed tube 2. Alternatively, if the article separation distance is greater than required, the control unit may command an increase in the feed rate to allow more rapid container filling.

Figure 3A:
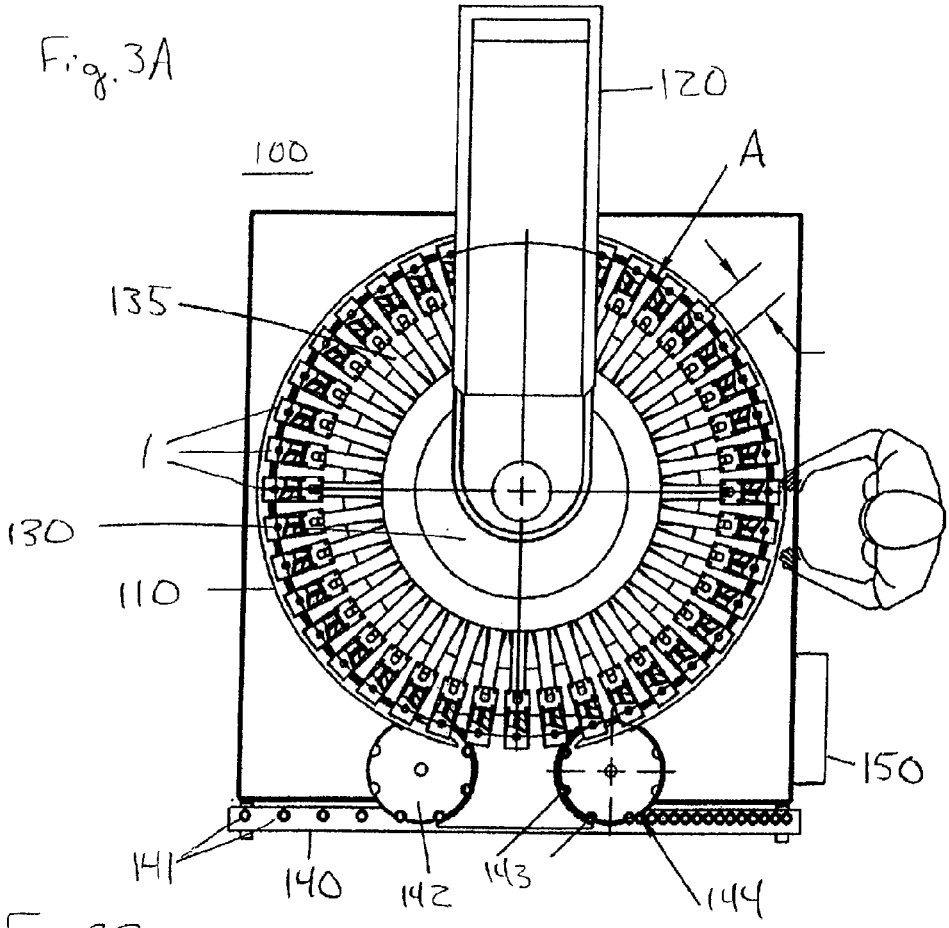
FIG. 3A is a plan view of a rotary carousel counting and filling apparatus in accordance with another embodiment of the present invention.
Figure 3B:
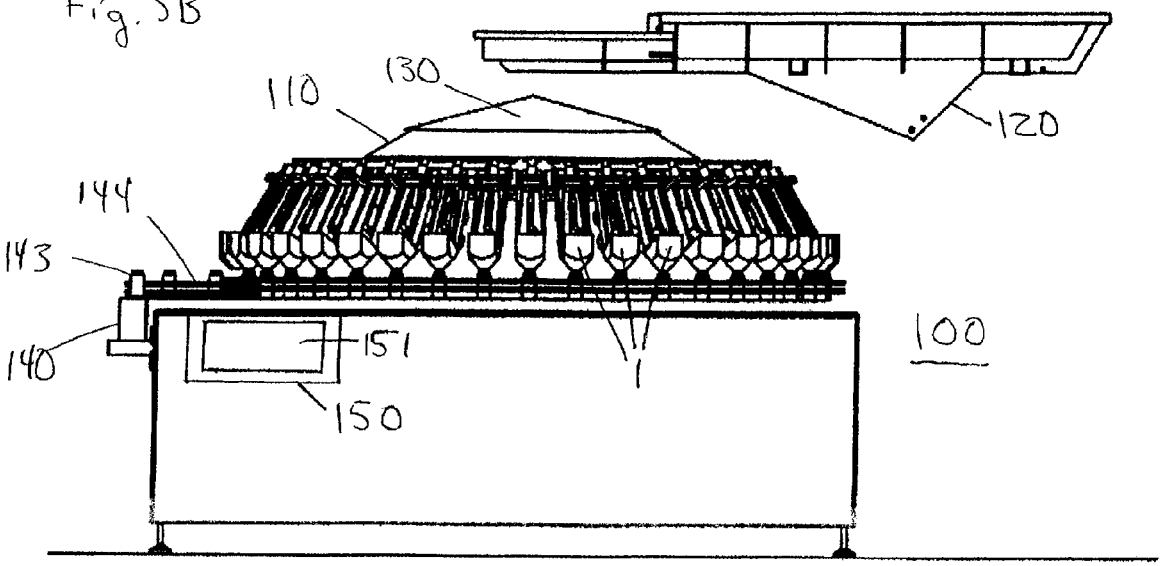
FIG. 3B is an elevation view of the embodiment of the present invention shown in FIG. 3A.

FIGS. 3A and 3B show overhead plan and elevation views, respectively, of a rotary carousel counting and filling apparatus 100 in accordance with another embodiment of the present invention. In this embodiment, a plurality of counting head assemblies 1, such as the assembly shown in FIGS. 1A, 1B, located on a rotating carousel head 110 of a rotary counting and filling platform. As the carousel head 110 rotates, clockwise in this embodiment, articles are dispensed from vibratory feeder 120 down onto the top of an article distribution dome 130. The articles are distributed essentially uniformly radially outward into feed troughs 135, which in turn direct articles into the feed tubes 2 of the counting head assemblies 1. The article feed rate from vibratory feeder 120 may be controlled independently of the rotary carousel operation, but preferably is controlled by a control unit 150 controlling the carousel operation so as to allow feedback control of the feeder to optimize article delivery to the counting head assemblies.

As the carousel rotates, a container conveyer 140 directs containers to be filled (containers 141) onto the carousel 110. Specifically, as the containers 141 approach the carousel, container loading wheel 142 picks up the containers from the conveyer. The loading wheel 142 is synchronized to the rotation of the carousel, in order to place a container onto the carousel under each counting head assembly as the assemblies pass the loading wheel. Once a container is loaded onto the carousel, it is filled in the manner illustrated in FIGS. 2A-2E, above, as the carousel rotates, i.e., any accumulated articles are released by outlet gate 40 to fall into the container, and further articles are allowed to fall through the counting head assembly until the detecting unit on the assembly signals a batch is complete and the control unit 150 commands the upper diverting gate 30's smart servo 35 to reposition the diverting gate to shut off article flow into the container and begin accumulating the next batch of articles in the counting head's other channel.

Preferably, the container has been filled with a complete batch of articles by the time the container and its counting head assembly have reached a predetermined position about the carousel, such as position A. Once the filled container 143 reaches container removal wheel 144, it is removed from the carousel and is passed by container conveyer 140 downstream for further processing, such as container sealing and labeling. If the container fill rate has been insufficient to fill the container by the predetermine position A about the carousel, or the detecting unit has provided a signal corresponding to the presence of a "bad batch" in the container, the container may be electronically identified by the control unit 150, and once returned to conveyer 140, manually or automatically removed from the filled container processing line at a downstream location.

As the carousel continues to rotate past the container removal wheel 144, articles continuously accumulate over outlet gate 40 until the counting head assembly passes container loading wheel 142 and a new container 141 is located beneath the counting head assembly's outlet port 50, and the container batch filling process is repeated.

The control unit 150, which may advantageously have a touch-panel user interface 151, simultaneously receives signals from each of the detecting units 10 on the plurality of counting head assemblies 1, from a "container present" indication switch beneath each counting head assembly, and controls the operation of each counting head assembly's upper diverting gate 30 and lower outlet gate 40 in response to their respective detecting unit's signals as the carousel is rotating. In addition, the control unit 150 receives article separation signals from all the detecting units 10, and may command adjustments to feed unit 120's article feed rate and/or the rotation speed of the carousel to optimize the speed of the article counting and container filling operations. The control unit may also provide equipment diagnostic functions to assist operator maintenance of the apparatus, as well as performing other functions, such as cataloguing and storing container fill data and apparatus performance data.

Figure 4:
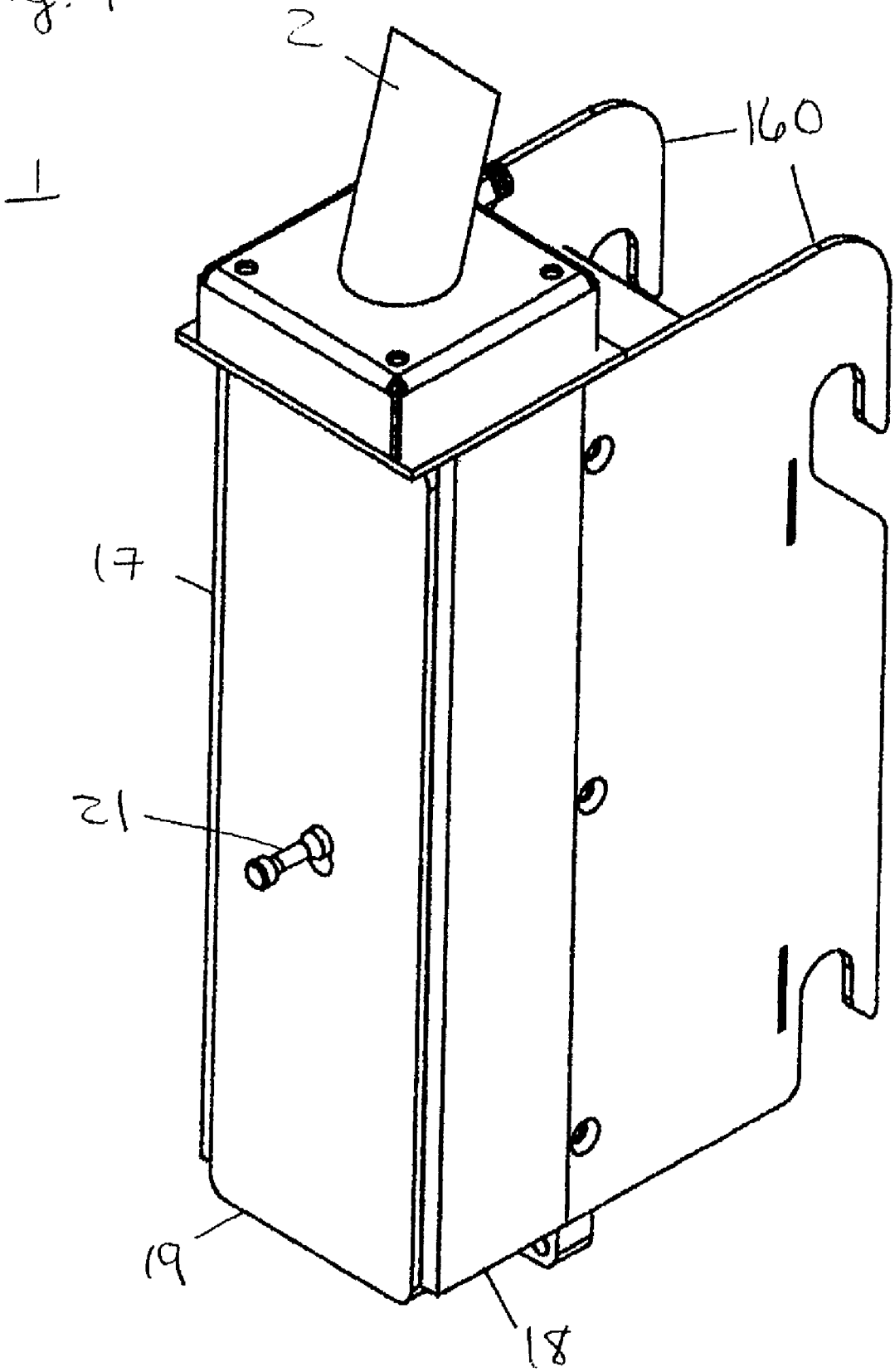
FIG. 4 is a perspective view of an embodiment of one of the counting head assemblies shown in FIGS. 3A and 3B, showing an embodiment of attachment mounting brackets to facilitate rapid, secure location of the counting head assemblies on the rotary carousel.

In order to facilitate rapid removal and replacement of counting head assemblies on the carousel, the assemblies 1 may be provided with mounting bracket plates 160, as illustrated in FIG. 4, which engage corresponding locating lugs on the carousel (not illustrated). When combined with quick-disconnect electrical connectors, the modular nature of the individual counting head assemblies allows the assemblies to be very quickly removed from the carousel and replaced with substitute assemblies, so that the carousel may continue in operation while the removed units are being serviced or cleaned.

Other multi-head continuous batch filling embodiments are also readily envisioned. For example, as shown in FIGS. 5A and 5B, rather than the foregoing rotary carousel apparatus, a linear filling station 200 may be constructed. In this embodiment, a plurality of counting head assemblies 1 are placed adjacent to one another above a container conveyer 240. The conveyer is provided with a screw-type container spacing unit 245 (the spacing screw being separately illustrated in FIG. 5A), which, when rotated by a screw drive unit 246 simultaneously drives containers to be filled forward and spaces the containers beneath filling troughs 210. In this embodiment, the filling troughs 210 receive articles which pass through two adjacent counting head assemblies, an arrangement which increases container filling rates while maintaining article feed rates into the individual counting head assemblies within a preferred range which is approximately one-half of the container filling rate.

Unlike the previous rotary carousel embodiment, in this embodiment, the containers are processed in groups of four with discontinuous container movement. The containers are indexed by container spacing unit 245 to stationary filling positions under the four troughs 210 shown in the figures, the containers are held stationary while being filled, and then the filled containers are advanced further down conveyer 240 for additional container processing (sealing, labeling, etc.).

Notwithstanding the discontinuous container movement in this embodiment, with the present counting head assemblies' continuous article counting and accumulation capabilities, the linear filling arrangement counts and accumulates articles in essentially the same manner as with the rotary carousel, despite the discontinuous container indexing on conveyer 240. As with the rotary carousel, articles loaded into source bin 220 (which may be provided with a mirror 221, to facilitate operator checking of bin fill from the floor) are fed by vibratory feeder trays 230 into the article feed tubes 2 of each of the counting head assemblies 1. Due to the vibration, the bulk articles are moved along one or more tracks leading from the source bin to the counting head. This movement separates and singulates (causes the product to assume a single file) the articles. Control unit 250, in addition to providing the operator with a user interface and controlling the feed rate of the vibratory feeders and upper diverting gates in the manner described above, controls the outlet gates in each of the counting head assemblies 1 to accumulate articles when a container is not present under the assembly (as when new containers are being indexed into position), similar to the accumulation during the rotation of the carousel when a counting head assembly is moving between the filled container removal wheel 144 and the container loading wheel 142.

Figure 6:
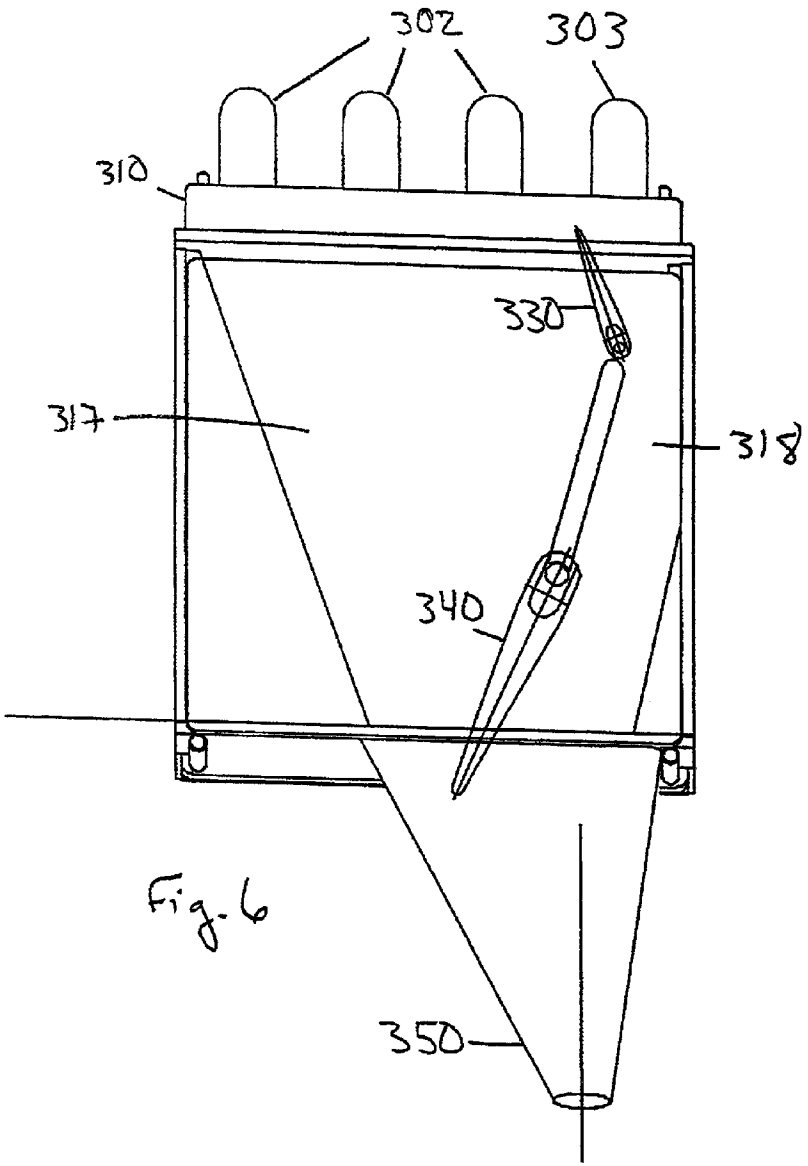
FIG. 6 is an elevation view of another embodiment of a counting head assembly in accordance with another embodiment the present invention.

A further embodiment of the present invention includes a plurality of chamber inlets and corresponding detecting units, as illustrated in FIG. 6. In this exemplary embodiment, the three additional fill tubes 302, each feeding articles to one of three additional detecting units within detecting unit housing 310, permit the counting head assembly to support higher rate container filling operations (in this example embodiment, at least three times the fill rate of the single fill tube embodiment in FIGS. 1A, 1B). In addition, this multi-detecting unit embodiment permits the counting head assembly gates to be controlled in a manner which allows rapid initial filling of a container, followed by slower, more highly controlled final completion of the batch with articles passing through only a single fill tube. For example, in the present embodiment, articles may pass at a high flow rate through all four of the fill tubes 302 and 303, while upper diverting gate 330 and lower outlet gate 340 are positioned to not block the entrance or exit of either left channel 317 or right channel 318. This permits a high article flow into a container beneath the chamber outlet 350. After the majority of the articles in a batch (for example, 90% of the batch) have passed through the detecting units in detecting unit housing 310, the article feed device feeding articles into the three feed tubes 302 above channel 317 (feed device not illustrated in FIG. 6) is briefly stopped or caused to "stutter," such that the flow of articles through the three fill tubes is temporarily halted until the articles already counted can pass beyond lower outlet gate 340, and the outlet gate 340 can be repositioned to block the outlet of left channel 317. Once the outlet gate has been repositioned to block channel 317, the feed device for the three left channel feed tubes 302 may be restarted, and the articles passing through these fill tubes begin to accumulate above outlet gate 340. In the meantime, while the feeding of articles through the three left channel fill tubes is stopped and the outlet gate 340 is being repositioned to block the channel 317 outlet, a separate feed device for the single fill tube 303 above the right channel 318 continues to feed articles into channel 318 and thence into the nearly-complete article batch in the container below. Once the final article of the batch is detected and passes into right channel 318, upper diverting gate 330 may be repositioned in the manner described above to block the entrance to channel 318 and divert further article flow into channel 317, where the additional articles join the articles already accumulating above outlet gate 317 from the three fill tubes 302. Finally, once the container containing the now-complete article batch is replaced by a new container, both gates may be repositioned to intermediate positions (i.e., positions not blocking the entrance or outlet of either channel), allowing the articles accumulated above outlet gate 340 to fall into the new container and to reestablish article flow in both channels.

The foregoing multi-fill tube, multi-detecting unit embodiment thus allows very high speed container filling while retaining the extraordinarily high batch accuracy of the other foregoing embodiments. This embodiment further allows substantial cost savings as compared to a comparable number of counting heads having single fill tubes and detecting units, as only one pair of costly gate repositioning devices to manage article flow, rather than several pairs. One of ordinary skill will readily recognize that the number of fill tubes and detectors on either side of the divider is not limited, other than by physical space constraints, and similarly, that additional channels may be defined in a housing chamber with additional dividers and corresponding diverting and outlet gates.

In addition to the foregoing alternative arrangements of counting and filling systems, alternative methods of counting head assembly operation are readily envisioned. For example, rather than repositioning the lower outlet gate to allow partially accumulated batches of articles to fall into a container following placement of a new container under a counting head assembly, the control unit may control the outlet gate to remain shut until an entire batch is accumulated. Then, if the detecting unit signals that the batch is a "good" batch, i.e., one that is within a predetermined range, the outlet gate may be repositioned to all the articles to be released into container. Alternatively, if the batch is identified as a "bad" batch, e.g., a batch which is either over-or under-range or contains defective or otherwise unacceptable articles (such as articles of the wrong color), the bad batch could be held and released, for example, into a recycling bin, during the period when a container is not beneath the counting head assembly. This approach would eliminate the need for subsequent identification and removal of containers filled with unacceptable batches from the production line.

Although particular embodiments of the present invention have been illustrated and described, it will be apparent to those skilled in the art that various changes and modifications can be made without departing from the spirit of the present invention. It is therefore intended to encompass within the appended claims all such changes and modifications that fall within scope of the present invention.

What is claimed is:

1. A method for portioning discrete articles, comprising the steps of:

providing an article portioning system, said article portioning system comprising:

an article counting head housing comprising a chamber through which articles pass between a chamber inlet and a chamber outlet, a divider which divides at least a portion of the chamber vertically into two adjacent article flow channels, an upper diverting gate which is located adjacent to an upper end of the divider and below the chamber inlet, and is positionable to alternately block the flow of articles from entering one or the other of the two channels, a lower outlet gate which is located adjacent to a lower end of the divider and above the chamber outlet, and is positionable to alternately block the flow of articles from leaving one or the other of the two channels, and an article-detecting unit located above the upper diverting gate;

feeding a plurality of articles into the article portioning system;

generating signals corresponding to characteristics of the articles passing through the detecting unit, wherein the characteristics include at least one of a count of articles and a predetermined range of a predetermined specification, and the generated signals include at least a portion complete signal generated when a predetermined portion of articles has entered the detecting unit, and an out-of-specification signal when the detecting unit detects a characteristic which falls outside the predetermined range; and controlling, based on the generated signals, the positions of the upper diverting gate and the lower outlet gate, wherein positioning initially the gates to block the flow of articles into or from a first one of the two channels, generating a portion complete signal, moving the upper diverting gate to a position which blocks article flow into a second of the two channels, such that only the completed portion is allowed to pass through the second channel to the chamber outlet and further articles are diverted into the first channel, moving the lower outlet gate to block the second channel when the articles passing through the second channel are no longer beneath the chamber outlet and thereby allowing articles in the first channel to pass through the chamber outlet, generating a portion complete signal corresponding to a complete portion passing through the first channel, returning the upper diverting gate to the position blocking the flow of articles into the first channel, and returning the lower outlet gate to the position blocking the flow of articles from the first channel when the articles passing through the first channel are no longer beneath the chamber outlet and thereby allowing the articles in the second channel to pass through the chamber outlet.

2. The method for portioning discrete articles of claim 1, wherein the step of providing the article portioning system further comprises providing a plurality of the article counting head assemblies located adjacent to one another about the outer periphery of a carousel, further comprising the steps of:

rotating the carousel while feeding containers to be filled onto the carousel beneath the chamber outlets of each of the assemblies as the assemblies pass a container loading position;

filling the containers as the carousel rotates; and removing filled containers from the carousel as the filled containers pass a container removal position.

3. The method for portioning discrete articles of claim 1, wherein the step of providing the article portioning system further comprises providing a plurality of the article counting head assemblies located adjacent to one another in cooperative alignment with a container conveyor, further comprising the steps of:

providing containers to be filled beneath the chamber outlets of each of the assemblies;

filling the containers; and removing filled containers from the container conveyor as the filled containers pass a container removal position.

* * * * *